US012723827B2

(12) United States Patent
Avbar et al.

(10) Patent No.: US 12,723,827 B2
(45) Date of Patent: Sep. 1, 2026

(54) STAKED BOLT CARRIER FOR A FIREARM

(71) Applicant: GLOCK TECHNOLOGY GMBH, Ferlach (AT)

(72) Inventors: Matija Avbar, Klagenfurt (AT); Gerald Schader, Gurnitz (AT); Karl Markut, Klagenfurt (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 0 days.

(21) Appl. No.: 19/324,030

(22) Filed: Sep. 9, 2025

(65) Prior Publication Data

US 2026/0071833 A1 Mar. 12, 2026

(30) Foreign Application Priority Data

Sep. 10, 2024 (EP) ..... 24199407

(51) Int. Cl.
*F41A 5/24* (2006.01)

(52) U.S. Cl.
CPC ..... *F41A 5/24* (2013.01)

(58) Field of Classification Search
CPC ..... F41A 5/24
USPC ..... 89/191.01
See application file for complete search history.

(56) References Cited

U.S. PATENT DOCUMENTS

| | | | | |
|---|---|---|---|---|
| 9,435,593 | B2 | 9/2016 | Mcginty | |
| 9,470,469 | B2 | 10/2016 | Daniel | |
| 9,664,467 | B2 | 5/2017 | Christenson | |
| 2014/0060311 | A1 | 3/2014 | Christenson | |
| 2015/0241149 | A1 | 8/2015 | Mcmillen, IV | |
| 2016/0076834 | A1* | 3/2016 | McGinty | F41A 5/28 89/194 |
| 2018/0094889 | A1 | 4/2018 | Gomez | |
| 2019/0072345 | A1* | 3/2019 | Kramer | F41A 5/24 |
| 2025/0314441 | A1* | 10/2025 | Greene, III | F41A 21/48 |

OTHER PUBLICATIONS

Webpage: OCKS (Forward Controls Design) published Dec. 18, 2020, original URL https://www.forwardcontrolsdesign.com/OCKS_p_149.html; retrieved from the Internet Archive of Sep. 10, 2025 (https://web.archive.org/web/20201218083937/https://www.forwardcontrolsdesign.com/OCKS_p_149.html).

* cited by examiner

*Primary Examiner* — Bret Hayes
(74) *Attorney, Agent, or Firm* — Raven Patents, LLC; Anton E. Skaugset

(57) ABSTRACT

A bolt carrier assembly for a firearm, including a bolt carrier and a gas key, the gas key having at least one hole along a median plane for receiving a fastening element, and the hole including a bore extending along the hole axis and through a central point and a recess in the upper region. The gas key includes a region of minimal wall thickness, and the gas key is fastened to the bolt carrier by means of at least one fastening element, where for securing the fastening element at least one staking is formed on at least one side wall of the gas key that is spaced apart from the region of minimal wall thickness.

27 Claims, 10 Drawing Sheets

STAKED BOLT CARRIER FOR A FIREARM

TECHNICAL FIELD

The present disclosure relates generally to firearms, and more particularly to bolt carrier assemblies for firearms. The present disclosure furthermore relates to methods for producing a staked gas key and to a staking punch which has been developed for said staking method.

BACKGROUND

A bolt carrier assembly may comprise a bolt carrier, a bolt head with a cam pin and a firing pin. In particular, a bolt carrier assembly for firearms of the M4/M16/AR15 type and similar systems may comprise a gas key. The gas key is an important part of these types of rifle, ensuring reliable operation and easy cleaning, as well as reduced recoil. The gas key diverts gases produced when a cartridge is fired from the barrel into the bolt carrier, in which the bolt head acts as a gas pressure piston. The operation is as follows: hot gases flow out of the barrel when the cartridge is fired. Some of these gases are diverted through a small opening in the barrel, known as the gas discharge port. The gases flow from the gas discharge port via a gas block into a gas tube which conducts them to a gas pressure piston, where they push against the gas pressure piston resulting in the gas pressure piston being pushed rearward. The gas pressure piston is connected to the bolt carrier, and the rearward movement of the gas pressure piston also moves the bolt carrier rearwards, in the process pulling the spent cartridge casing out of the cartridge chamber and ejecting it from the rifle. At the same time, the bolt carrier tensions the hammer. The bolt carrier is then moved forward by the force of a buffer spring, as a result of which the next cartridge of a loaded magazine is stripped from the magazine and loaded into the cartridge chamber.

The most common method for fastening a gas key to a bolt carrier is a screw connection using a hexagon socket screw or recessed head screw. This provides a simple, reliable, and stable connection, which is crucial for the satisfactory operation of an autoloading rifle. In order to prevent loosening of the screws, screw locks by means of adhesive joints are used in the prior art. Although screw locks by means of adhesive joints may improve the reliability of the connection between the gas key and bolt carrier, they also have some disadvantages. For example, the use of too much adhesive may cause the movement of the gas key to be impaired, which may lead to malfunctions of the rifle. Furthermore, it may be the case that the screw lock wears out over time due to thermal, mechanical or chemical stress and thereby loses its effect, as a result of which the connection between the gas key and bolt carrier becomes loose, which may render the rifle inoperable. It has been attempted in the prior art to solve the problem in different ways.

US Patent Publication no. 2015/241149 discloses the classic case of an assembly for a gas key of an autoloading rifle, where the gas key is fastened to the bolt carrier with screws, and which can be secured against falling out by means of thread-locking by adhesive bonding or by riveting the gas key on the bolt carrier. The disadvantage of adhesive bonding is that the screw lock is less reliable, and the disadvantage of riveting is the lack of releasability of the connection.

U.S. Pat. No. 9,664,467 discloses an assembly for a gas key of an autoloading rifle, where the gas key has a slot for receiving a key element in the slot and the key element has a dovetail rail which sits in the slot overlaying the fastening elements, in order to fasten the gas key removably to the bolt carrier. For this purpose, an approximately T-shaped key element has to be inserted into the dovetail rail, which prevents unintentional separation of the gas key from the bolt carrier. The disadvantage of this method is the necessity of an additional component, which adds additional weight and additional complexity to the assembly.

U.S. Pat. No. 9,470,469 discloses an assembly in which securing by means of an O-ring is proposed. The disadvantage of this is that the additional O-ring increases the complexity of the assembly. Furthermore, the conditions associated with long-term firearm use lead to an accelerated aging of the rubber and thus increase the maintenance required for the weapon.

A further possibility for the screw lock is disclosed by U.S. Pat. No. 9,435,593, in which the gas key of an autoloading rifle is held in position by means of a bridge. As an additional securing measure, the screws may be staked. This is understood in this context as meaning the securing of a recessed head screw where the material in the edge region of the bore is compressed into the slot in the screw head with a center punch or a similar tool at the edge of the counterbore. The disadvantage of this method is that this procedure can only be carried out with slotted screws and recessed head screws. However, the use of such screws is unconventional in assemblies for a gas key of an autoloading rifle. In addition, applying the center punch requires a great deal of precision to prevent damage to the screw. However, even if the center punching takes place with sufficient precision, a sufficient wall thickness has to be provided for a center punch to prevent cracks in the side wall of the gas key. This design requirement results, however, in thinner screw diameters, which means less torque can be applied when fixing the gas key to the bolt carrier, and the number of shots until the required retightening of the screws is reduced.

There is thus a need for an improved autoloading rifle having a bolt carrier assembly that includes a gas key and a bolt carrier, where the gas key is fastened to the bolt carrier with screws and the screws are reliably secured against unintentional loosening without requiring either additional mechanical components or adhesive bonding, and where the screws further allow a higher torque to be applied when fixing the gas key to the bolt carrier, in order to increase the longevity of use or otherwise reduce the maintenance rates for the autoloading rifle.

SUMMARY

The present disclosure is directed to bolt carrier assemblies for firearms, including staking punches for producing the bolt carrier assemblies, and methods of using the staking punches. The bolt carrier assemblies include a gas key that is fastened to the bolt carrier with screws, and the screws are reliably secured against unintentional loosening by staking, resulting in increased operational reliability and decreased maintenance demands for the firearm.

In one example, the present disclosure is directed to a bolt carrier assembly for a firearm, where the firearm has a barrel that extends in a firing direction. The bolt carrier assembly includes a bolt carrier, and a gas key having a side wall, a guide surface, and an upper region; at least one hole is formed in the gas key along a median plane of the gas key, each hole including a bore that extends along a hole axis that through a central point and a recess in the upper region of the gas key, and each hole is configured to receive a fastening element; a region of minimal wall thickness of the gas key between the recess and the side wall is formed along a line that is normal to the median plane of the gas key and that intersects the hole axis; and the gas key is fastened to the bolt carrier by means of at least one fastening element, where the at least one fastening element is secured by at least one staking that includes at least one side wall of the gas key, where the at least one staking is formed at a depth in the at least one side wall, and the at least one staking is spaced apart from the region of minimal wall thickness, as seen in the firing direction.

In another example, the present disclosure is directed to a staking punch for producing a bolt carrier assembly as disclosed, where the staking punch has at least one head and a punch surface, where the punch surface is formed at an angle β of 90° to 96° to a transverse direction that is orthogonal to the firing direction, or at an angle λ of 30° to 70° in respect to the transverse direction.

The features, functions, and advantages of the disclosed bolt carrier assemblies and/or staking punches may be achieved independently in various embodiments of the present disclosure, or may be combined in yet other embodiments, further details of which can be seen with reference to the following description and drawings.

DETAILED DESCRIPTION OF PREFERRED EMBODIMENTS

Figure 1:
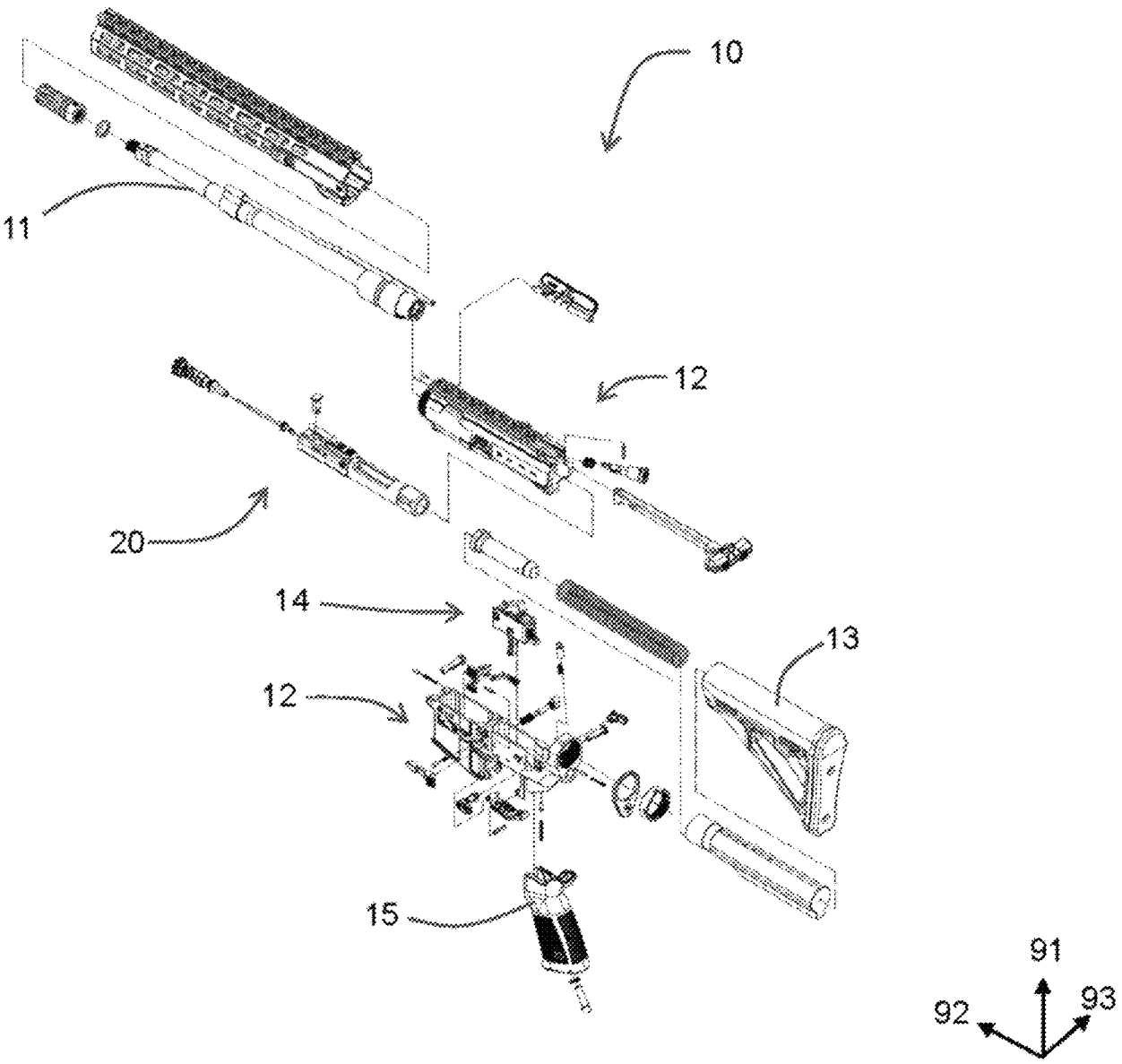
FIG. 1 is a schematic representation of a firearm according to the present disclosure in an exploded view.

As used in the present disclosure, the terms left, right, up, down, front and rear always refer to a shooter's view in the firing direction of the firearm when said firearm is held ready to fire. The terms "front," "rear," "above," "below," "inside," "outside," and so on are used in the generally accepted form and with reference to the object in its usual use position. This means that, for the weapon, the muzzle of the barrel is at the "front," that the breechblock or carriage is moved "backward" by the explosive gas, etc. Transverse to a direction substantially means a direction rotated by 90°.

A bolt carrier assembly for a firearm is provided herein, the bolt carrier assembly having a barrel which extends in the firing direction, including a bolt carrier and a gas key having a side wall and a guide surface. At least one hole for receiving in each case one fastening element per hole is formed on the gas key along a median plane, the hole has a recess in the upper region and in the lower region a bore which extends along a hole axis passing through the central point of the hole, where a region of minimal wall thickness is formed along a normal, which intersects the hole axis, to the median plane between recess and side wall, and the gas key is fastened to the bolt carrier by means of at least one fastening element, where for securing the at least one fastening element against twisting in each case at least one staking is provided on a side wall of the gas key, where the staking is formed at a depth in the side wall that is predetermined by pushing a staking punch against it. The staking, as seen in the firing direction, is spaced apart, i.e. is at a distance, from the region of minimal wall thickness and, as a result, a form-fitting and/or force-fitting, preferably at least force-fitting, connection is produced between the connecting element and gas key.

The disclosure also provides a staking punch suitable for staking the gas key of the bolt carrier assembly and a method for staking the gas key of the bolt carrier assembly by means of this staking punch.

A major advantage of the disclosed bolt carrier assembly is that the plastic deformation caused by the staking is not applied at the thinnest point of the material. This procedure is not obvious to a person skilled in the art, since such stakings in the prior art are carried out at the thinnest point of the material in order to have to expend as little deformation energy for the side walls as possible. In addition, when staking at the thinnest point, it is easily possible to slightly adjust the position of the staking and the degree of jamming. This solution results in acceptable results, but a minimum wall thickness of the side wall of the gas key always has to be maintained in this case to prevent the side wall from breaking. However, this design requirement limits the possible screw diameter and thus consequently the maximum tightening torque, which for its part leads to shorter maintenance intervals. By means of the spacing of the staking, a part of the side surface of the gas key having a greater wall thickness is staked, and although the deformation energy required at this point is greater than at the thinnest point of the wall, the result is that it is possible to reduce the minimal wall thickness of the bore at the gas key, which allows the use of screws with a larger cross section, and therefore a greater maximum tightening torque and consequently longer maintenance intervals.

In a particularly preferred embodiment, the gas key is staked with a staking punch, in which the profile of the staking surface has a rounded W shape. A rounded W shape should be understood here as meaning a convex-concave-convex sequence which has no sharp edges along the staking surface. The advantage of staking the gas key with a staking punch, in which the profile of the staking surface has a rounded W shape, is the reduction in sharp edges and thus in stress peaks along the staking notches.

Additional features and advantages of the presently disclosed bolt carrier assemblies will be explained in greater detail below with reference to the figures.

FIG. 1 shows a firearm 10 in an exploded view. In the case illustrated, the firearm 10 is a firearm of the M4/M16/AR15 type, but what is shown is analogously also applicable to similar systems. The firearm 10 comprises a barrel 11, a receiver 12, a buttstock 13, a trigger 14, a grip 15, and a bolt carrier assembly 20. For a better overview, a coordinate system with a vertical direction 91, firing direction 92 and transverse direction 93 is introduced.

Figure 2:
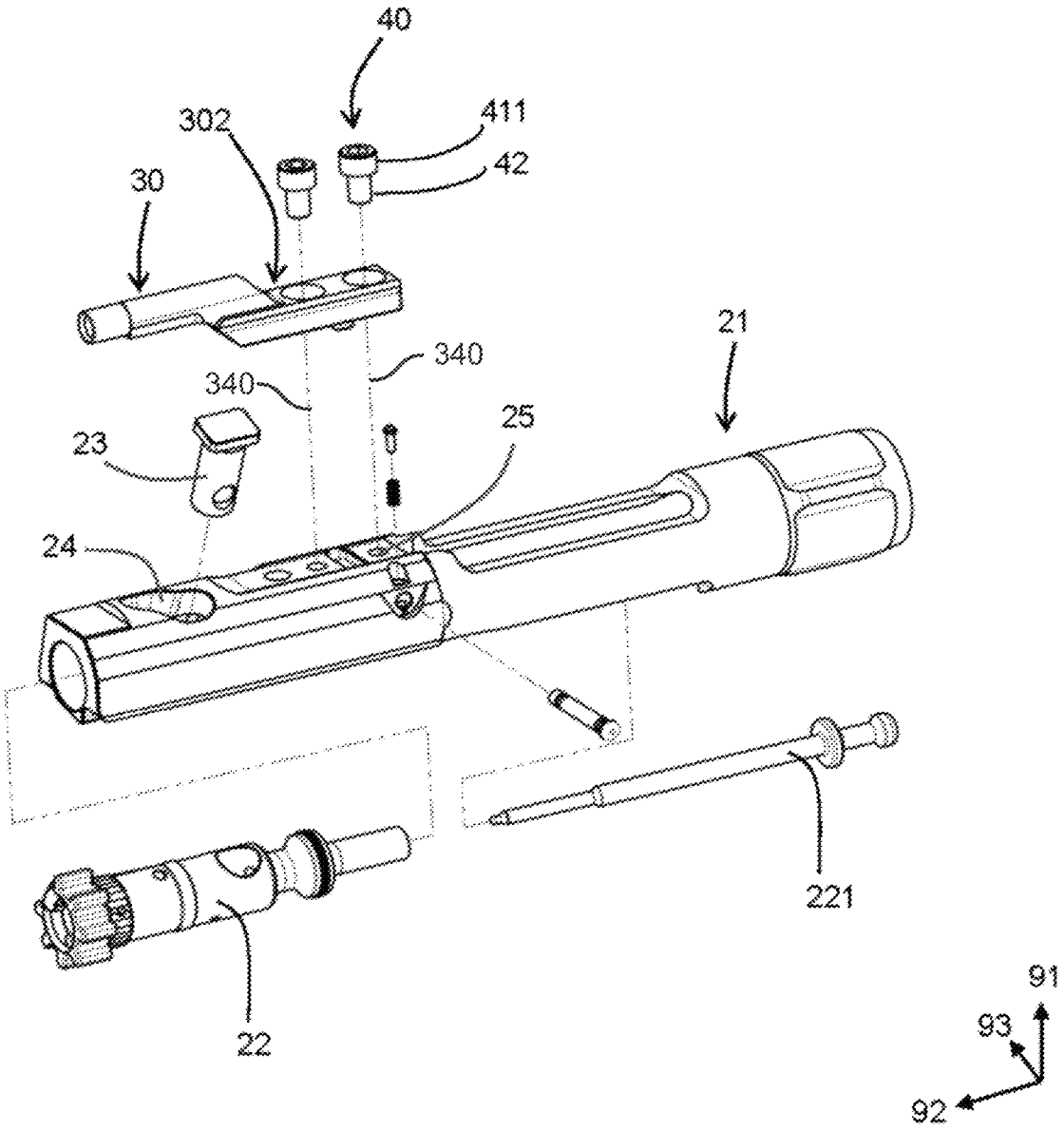
FIG. 2 shows an exploded view of the bolt carrier assembly of the firearm of FIG. 1.

FIG. 2 shows an exploded view of the bolt carrier assembly 20 of the firearm 10 from FIG. 1, comprising a bolt carrier 21, a bolt head 22, which is pushed into the bolt carrier 21 in the firing direction 92, a firing pin 221, which extends in the firing direction 92 within the bolt head 22 of the bolt carrier 21, a cam pin 23 which, as seen in the firing direction 92, is pushed from slightly left at the top, i.e. within the context of the coordinate system, from a position slightly rotated in the transverse direction 93 from the vertical direction 91, into a cam 24 of the bolt carrier 21, threaded holes 25 provided in the bolt carrier 21 on its top side 302, a gas key 30, which is attached to the bolt carrier 21 on the top side 302, and fastening elements 40 with a head 41 having a knurling 411 and a threaded shaft 42, which are used for fastening the gas key 30 to the bolt carrier 21. The number of fastening elements 40 shown in FIG. 2 is exemplary and, as a person skilled in the art knows from the prior art, may be more than the two illustrated and also may only be one. A usual number of fastening elements 40 is one to three, preferably two. As can be seen in FIG. 2, a bolt carrier assembly 20 usually comprises more than the enumerated elements, but this will not be discussed specifically below.

Figure 3:
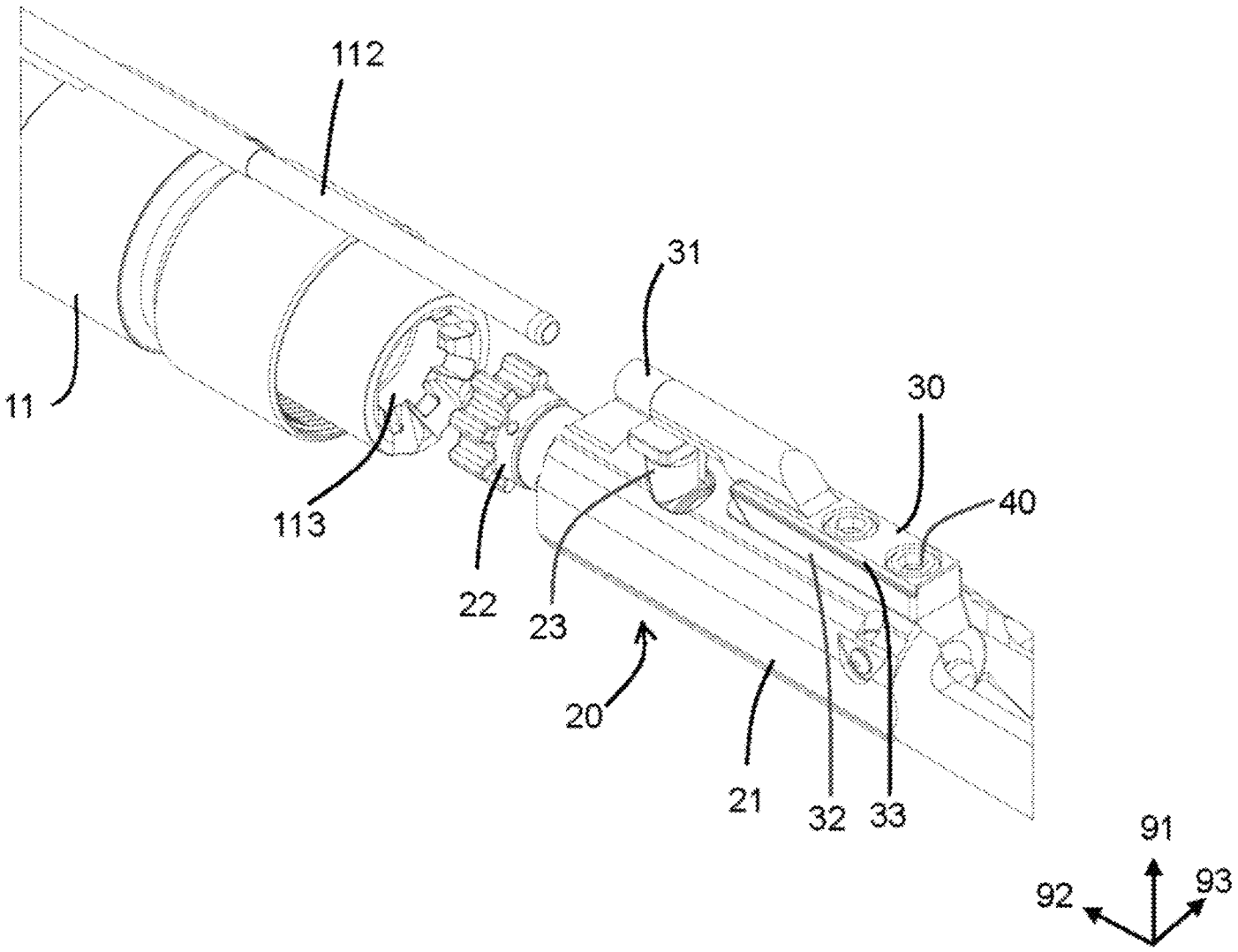
FIG. 3 shows an isometric view of the bolt carrier assembly and barrel of the firearm of FIG. 1.

FIG. 3 shows an isometric view of the bolt carrier assembly 20 and the barrel 11 of the firearm 10 from FIG. 1. The barrel 11 comprises a gas tube 112 and a locking chamber 113. The locking chamber 113 is designed such that it enters into engagement with the bolt head 22 in the assembled and locked state of the firearm 10. The bolt carrier assembly 20 is the assembled bolt carrier assembly 20 from FIG. 2. The bolt carrier assembly 20 comprises the gas key 30, comprising a gas tube receptacle 31, which enters into engagement with the gas tube 112 in the assembled state, a guide surface 32 and a side wall 33. The gas key 30 is connected in FIG. 3, as known from the prior art, in a form-fitting manner to the bolt carrier 21 by the fastening elements 40.

Figure 4A:
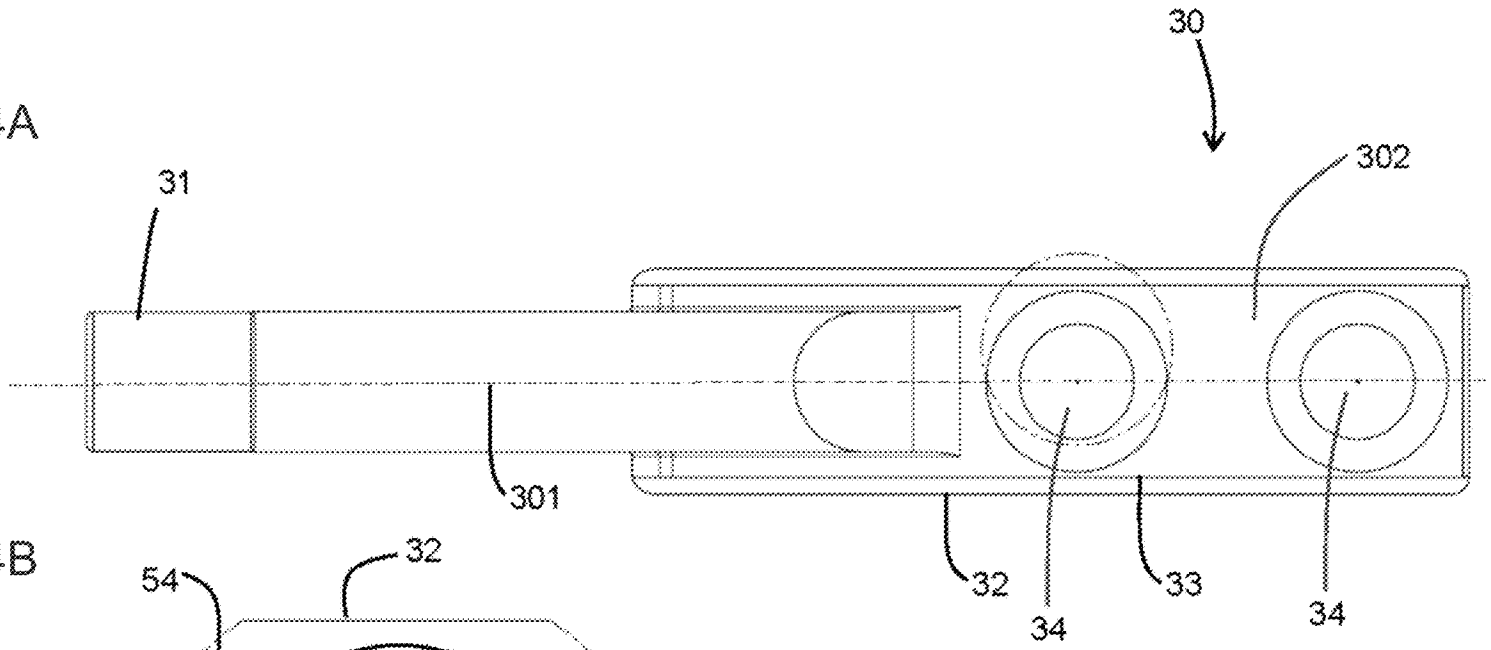
FIG. 4A shows a top view of the gas key of the firearm of FIG. 1.
Figure 4B:
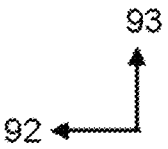
FIG. 4B shows an enlargement of the contact point of a staking punch according to the present disclosure.

FIG. 4A shows a top view of the gas key 30 of the firearm 10. Top view here means a view of the gas key 30 along the axis of the vertical direction 91. The gas key 30 comprises the gas tube receptacle 31, the guide surface 32, the side wall 33, the top side 302 and at least one hole 34, wherein said at least one hole 34, and in FIG. 4A the two holes 34, is/are arranged along a median plane 301 that is coincident with a vertical plane of symmetry of the gas key 30. A dash-dotted circle indicating the region under consideration of the detail in FIG. 4B is drawn around the left hole 34 in FIG. 4A. FIG. 4B shows the enlargement of contact points of a punch surface 54 of a staking punch 50 according to the present disclosure with the side wall 33 of the gas key 30. The contact points of the punch surface 54 with the side wall 33 are offset by an angle α, denoted by 38, in relation to the minimal wall thickness of the hole 34. The hole 34 comprises a bore 341, a recess 342, an inner surface 343 and a central point 345. The angle α is determined as the angle between a normal 36 to the side wall 33, towards the transverse direction 93, passing through the central point 345, and a leg 37 passing from the central point 345 to the contact point between the side wall 33 and the punch surface 54 of the staking punch 50. If there is no single contact point, but a line of contact along the firing direction 92, when looking at the gas key 30 from the vertical direction 91, then the equivalent to the contact point is in the middle of the line of contact. In other words: In case contact of the punch surface 54 with the side wall 33 is made by a plane surface area the middle point of the plane surface equals the contact point. As is immediately apparent, the area with the smallest wall thickness has to extend along the normal 36 between hole 34 and side wall 33. The angle α 38 between normal 36 and leg 37 is 7.7° to 50°, preferably 15° to 40°, particularly preferably 25° to 32°.

Figures 5A, 5B, 5C, 5D:
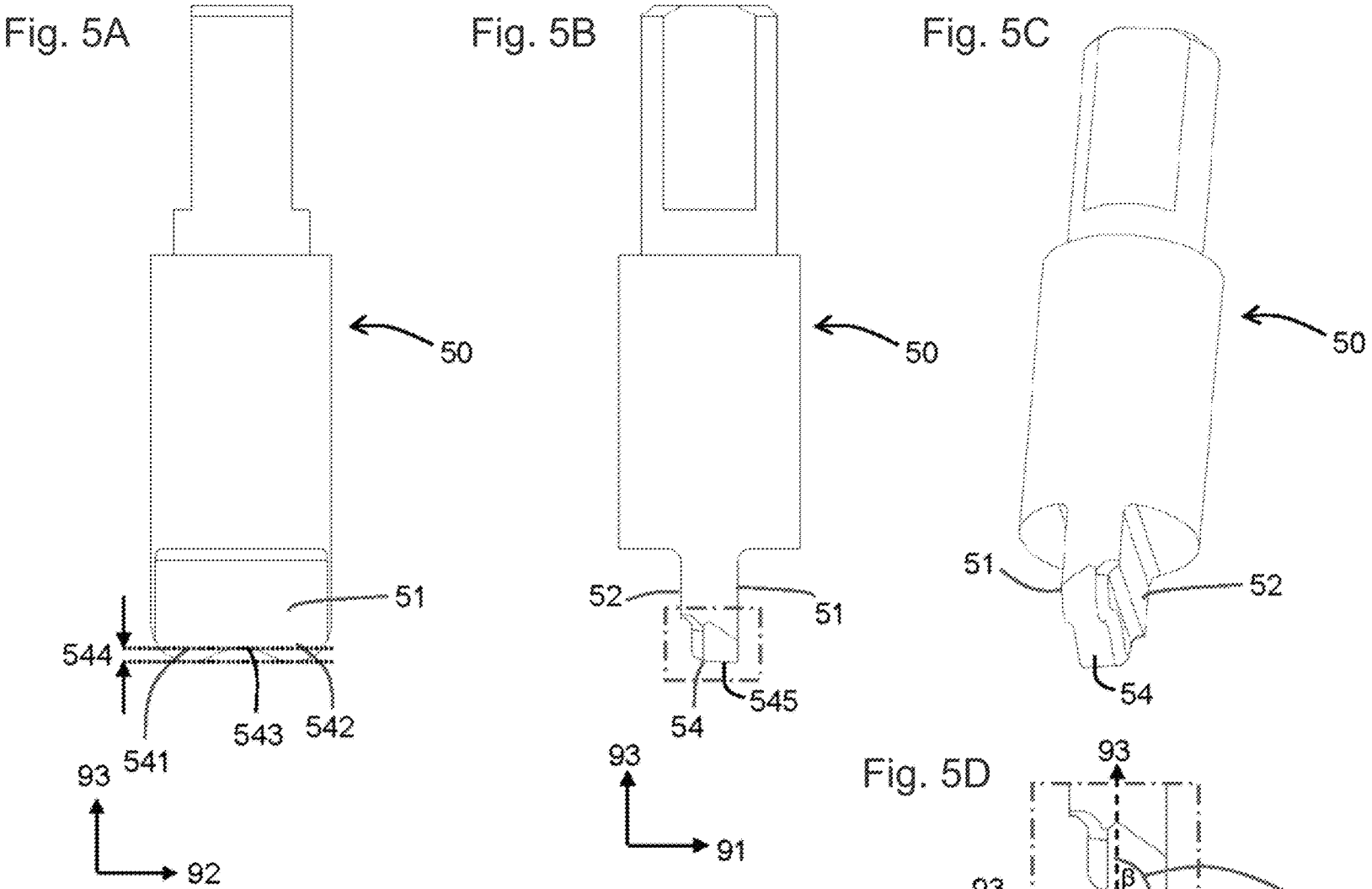
FIGS. 5A-5D show selected views of a preferred staking punch for the staking method of the present disclosure.

FIGS. 5A to 5C show three views of a preferred staking punch 50 for the staking method according to the present disclosure. The staking punch 50 comprises a top side 51, an underside 52, a punch surface 54, a first head 541, a second head 542, an indentation 543, a height difference 544 and a slope 545, which when the punch 50 is in working position is inclined by an angle β to the transverse direction 93, denoted by 546—see also FIG. 5D in this respect. This results in a punch imprint on the guide surface 32 of the gas key 30 that is inclined by the angle β (546) (see FIG. 7B), which forms a counter surface to the punch surface 54. In FIG. 5B, the head portion of the punch 50, which is illustrated in enlarged form in FIG. 5D, is marked as a detail. The first head 541 and the second head 542 usually have the same height difference 544 with respect to the indentation 543, but this is not absolutely required. In tests, the height difference 544 of 0.3 mm to 1 mm has proven to be practicable, preferably the height difference 544 is 0.5 mm to 0.8 mm and particularly preferably 0.55 mm to 0.7 mm. According to the present disclosure, the angle β (546) has a gradient of 90° to 96°, preferably 92° to 94°, particularly preferably of 93°. For fastening elements 40 being a screw of the type Imperial #10/32-UNF, which were used for tests for fastening a gas key 30 to a bolt carrier 21 and in which the bolt carrier assembly 20 was staked with a staking punch 50 according to the present disclosure, the result was a significant increase in the torque required for loosening the fastening elements 40 from 6.4-6.9 Nm in the unstaked state to 7-15 Nm in the staked state. For preferred fastening elements 40 being a screw of the type Imperial #10/32-UNF with a 0.8×45° chamfer, where the preferred angles of the staking punch 50 were used, the result was even an increase to at least 8.75 Nm.

Of course in alternate embodiments staking punch 50 has at least a first head 541. It is possible that staking punch 50 has only one head or in yet another embodiment staking punch 50 can comprise e.g. four heads. This is especially advantageous, since it can be used to generate more stakings 60 per pressing. Usually and as shown in FIG. 7 a gas key 30 according to prior art is fixed with two fastening elements 40 to the bolt carrier 21. The optimum number of stakings 60 per pressing of such gas key 30 is therefore eight.

Figure 6:
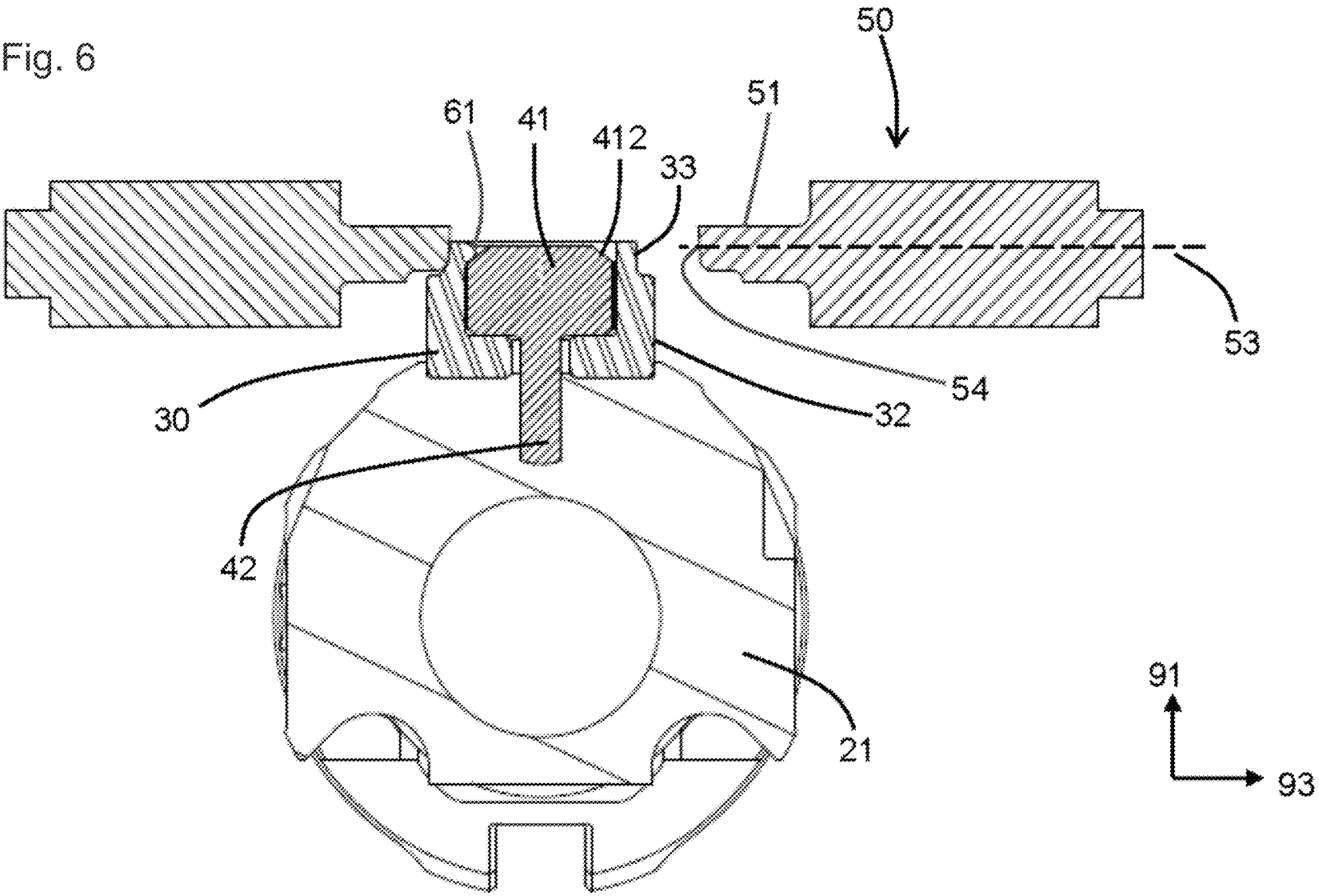
FIG. 6 shows a process of staking the gas key mounted on the bolt carrier, in this example using the staking punch of FIG. 5, from the view in the barrel direction.

FIG. 6 shows the process of staking the gas key 30 mounted on the bolt carrier 21 from the view in the firing direction 92. The fastening element 40 used for this purpose has a head 41 and a shaft 42, with the head 41 being able to have a chamfer 412. Preferably, the fastening element 40 is a screw of the type Imperial #10/32-UNF, particularly preferably with a 0.8×45° chamfer. However, the teaching of the disclosure is not limited to this screw as a fastening element 40; a person skilled in the art knows numerous other suitable fastening elements 40, with screws generally being preferred because of the connection being releasable. The gas key 30 comprises the guide surface 32 and the side wall 33. During the staking method, the punch surface 54 of the staking punch 50 is brought into contact with the side wall 33 of the gas key 30. As can readily be seen, the staking punch 50 is aligned in this case such that its top side 51 is at the top in the vertical direction 91. The angle β (546) is then formed between a 91, 92 plane, which is placed at the upper edge of the staking punch 50, and the punch surface 54 (dropping obliquely). If the staking punch 50 is now pushed onto the gas key 30 in the transverse direction 93, the side wall 33 of the gas key 30 deforms in such a way that it comes into engagement with the knurling 411, provided such a knurling is present. If, in addition, there is a chamfer 412 on the head 41 of the fastening element 40, a bead 61 is formed, which additionally secures the fastening element 40 axially. The punch 50 when pressed in the transverse direction 93 as described above is in working position.

It should be mentioned that the section shown in FIG. 6 does not pass through the central point 345 of the hole 34, since the staking, as can be seen in FIG. 4B, takes place offset by the angle α. The necessary staking pressure and the depth resulting therefrom can be easily determined and adapted by a person skilled in the art.

Figure 7A:
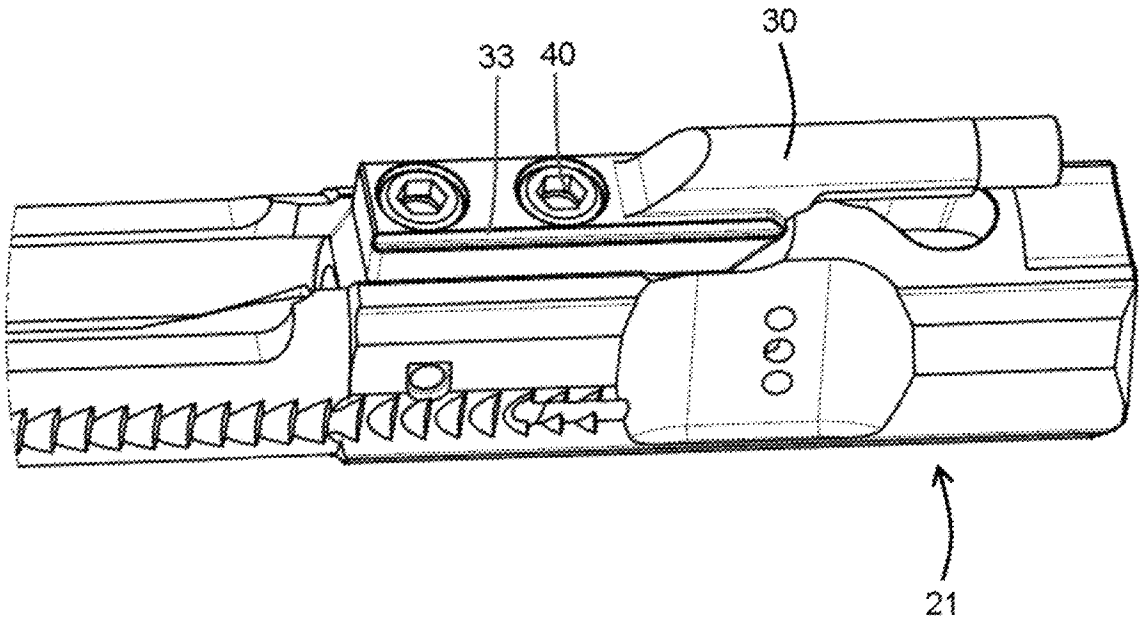
FIG. 7A shows an isometric view of the unstaked bolt carrier assembly.
Figure 7B:
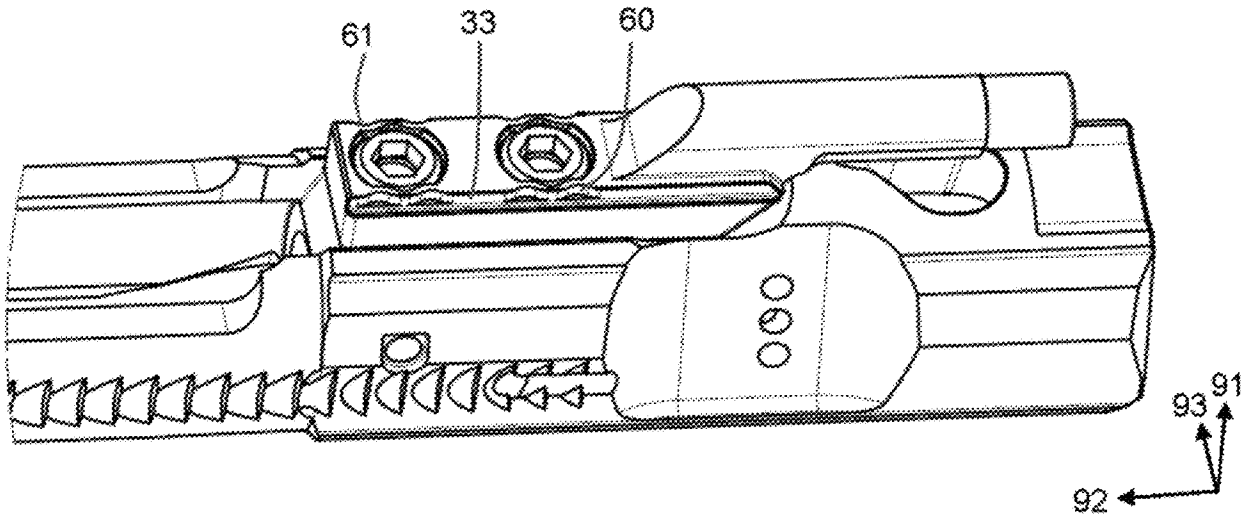
FIG. 7B shows an isometric view of the staked bolt carrier assembly.

FIGS. 7A and 7B show two isometric views, where one of the views is of the unstaked bolt carrier assembly 20 (FIG. 7A) and one of the views is of the staked bolt carrier assembly 20 (FIG. 7B). The state before the staking can be seen in FIG. 7A. The gas key 30 is connected to the bolt carrier 21 by means of the fastening elements 40. The subsequent staking of the side walls 33 according to FIG. 6 leads to FIG. 7B where, by means of the staking process, stakings 60 in a position at a distance from the normal 36 (see FIG. 4B) and the formation of the beads 61 (see FIG. 6) can be seen.

The further assembly of the bolt carrier assembly 20, analogously to FIG. 2, can be carried out after the staking.

Figure 8A:
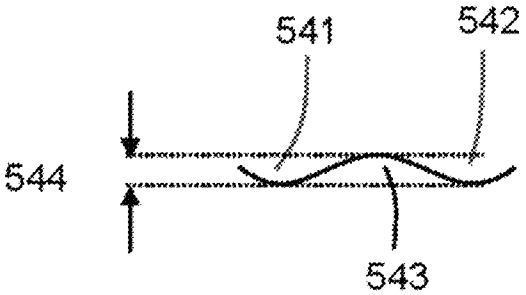
FIGS. 8A-8E show profile views of the staking surfaces of selected illustrative staking punches which are useful for the staking method of the present disclosure.
Figure 8B:
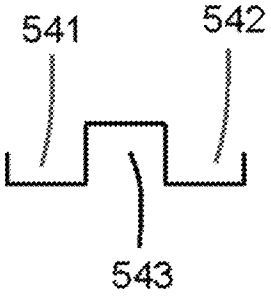
Figure 8C:
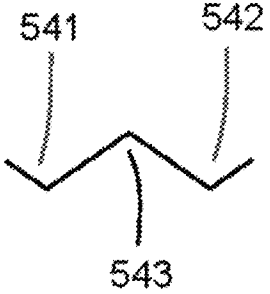
Figure 8D:
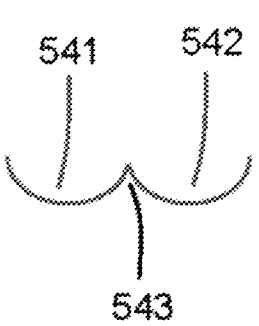
Figure 8E:
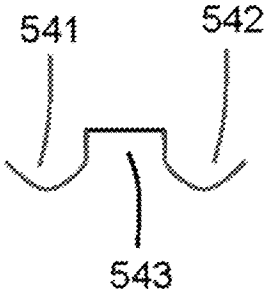

FIGS. 8A-8E show profile views of the punch surfaces 54 of staking punches 50 according to FIG. 5, which can be used for the staking method. Preferred staking punches 50 have a first head 541 and a second head 542, and also an indentation 543, between which there is a height difference 544. This height difference may be, but does not have to be, the same size for both staking heads 541, 542. Preferably, the staking surface 54 does not have any sharp edges in the profile in the region of the staking heads 541, 542, as can be seen in FIGS. 8A, 8D and 8E. Particularly preferably, the staking surface 54 does not have any sharp edges in the entire profile, for example, the staking surface 54 has a rounded W shape, as can be seen in FIG. 8A.

FIG. 9 shows views of another preferred staking punch 50 suitable for staking the gas key 30 of the bolt carrier assembly 20. The staking punch 50 comprises a top side 51, an preferably flattened underside 52, a punch surface 54, a first head 541, a second head 542, an indentation 543, a height difference 544 and a slope 545, which when the punch 50 is in working position is inclined by an angle λ (549) to the plane panned by the firing direction 92 and the transverse direction 93—see also FIG. 9D in this respect. As can be seen from FIG. 9, a staking punch 50 according to the present disclosure can also be formed as an assembly of two individual staking punches 501, 502, wherein the first staking punch 501 comprises the first head 541 and the second staking punch 502 comprises the second head 542 whereas the individual staking punches 501, 502 are arranged side by side with flats 547 next to each other. The configuration of the staking punch 50 as seen in FIG. 9A and FIG. 9C is comprised out of two parts 501, 502 (one with the first head 541 and the second with the second head 542) which leads to the indentation 543 in between the two parts. As can be seen from FIG. 9E the staking punch 50 may also comprise only one of the parts. In this case there is of course no indentation 543 present in the staking punch 50. FIG. 9B shows a staking punch 50 according to FIG. 9A as seen from the firing direction. The head portion of the staking punch 50, which is illustrated in enlarged form in FIG. 9D, is rotational symmetrical and marked as a detail in FIG. 9B. The first head 541 and the second head 542 usually have the same height difference 544 with respect to the indentation 543, but this is not absolutely required. Furthermore the staking punch 50 does not have to be rotation symmetrical, even if it only comprises one of two individual staking punches 501, 502.

Figure 9C:
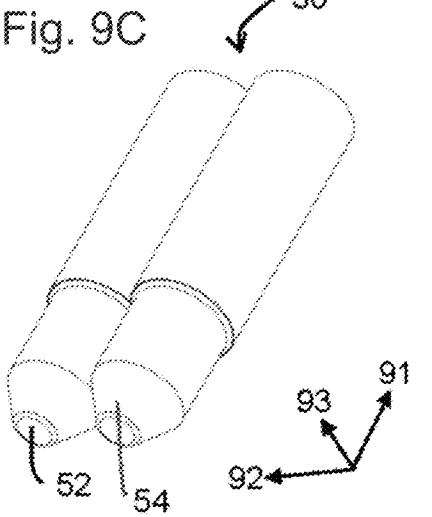
FIGS. 9A-9E show selected views of an alternative and preferred staking punch useful for the staking method of the present disclosure.
Figure 9E:
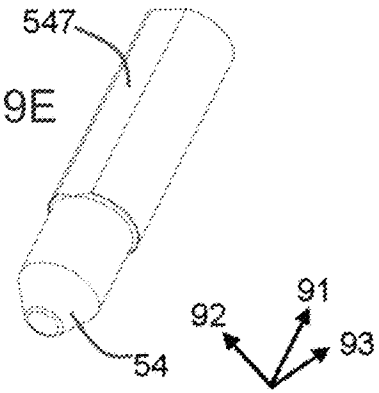
Figure 9B:
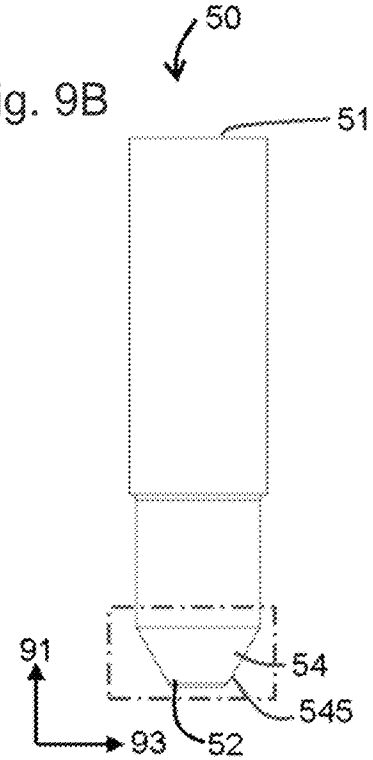
Figure 9D:
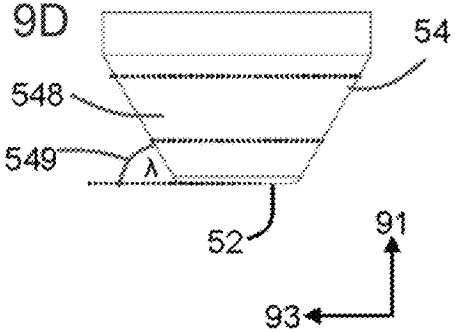
Figure 9A:
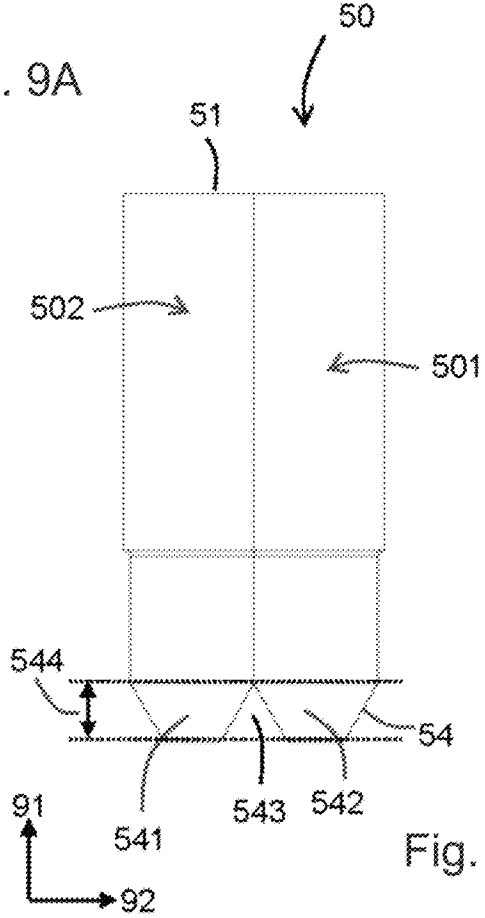

An embodiment in which the staking punch 50 comprises a pack of four individual staking punches 501, 502, each of them with a staking head 541, 542 from FIG. 9E is especially advantageous, since it can be used to generate four stakings 60 per pressing or eight stakings 60 with only two pressings. This is done by arranging the staking punches 50 side by side with the flats 547 next to each other. It is also possible to arrange eight individual staking punches 50 from FIG. 9 which is especially be advantageous. Usually and as shown in FIG. 7 a gas key 30 according to prior art is fixed with two fastening elements 40 to the bolt carrier 21. The optimum number of stakings 60 per pressing of such gas key 30 is therefore eight.

In tests, the height difference 544 of at least 8 mm has proven to be practicable.

Figure 4B:
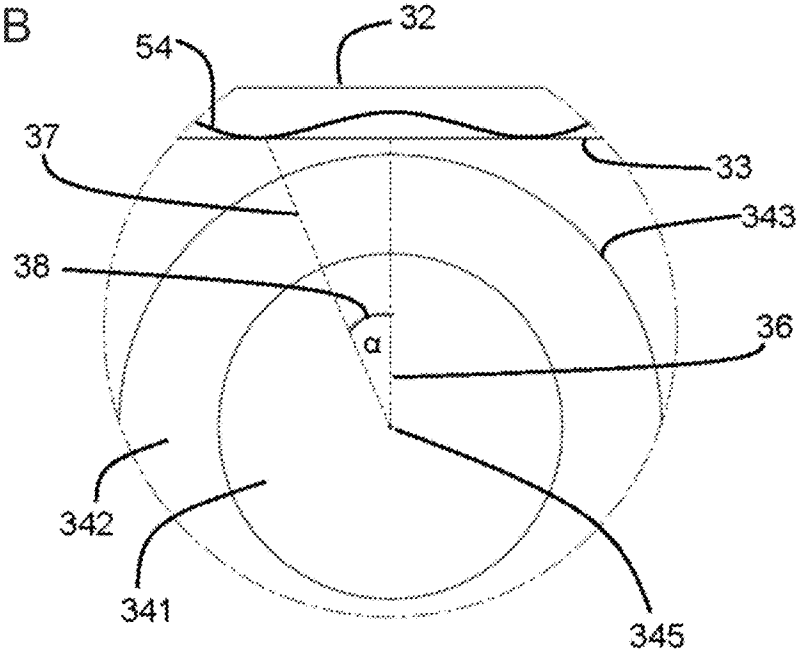

According to the present disclosure, the angle λ (459) has a gradient of 30° to 70°, preferably 40° to 65°, particularly preferably of 45 to 60°. Each of the staking heads 541, 542 has to be configured to ensure the points of contact between the side wall 33 and the punch surface 54 are in an angle α 38 in accordance with the description of FIG. 4. These contact points usually lie within a middle portion 548 of the staking punch head 541, 542 on the punch surface 54. In a preferred embodiment the staking punch head 541, 542 is formed in such a way to ensure that the entire staking process is performed by the middle portion 548 of the staking punch head 541, 542. This construction is easy to achieve by a person skilled in the art. This is an easy task for the person skilled in the arts.

Figure 10:
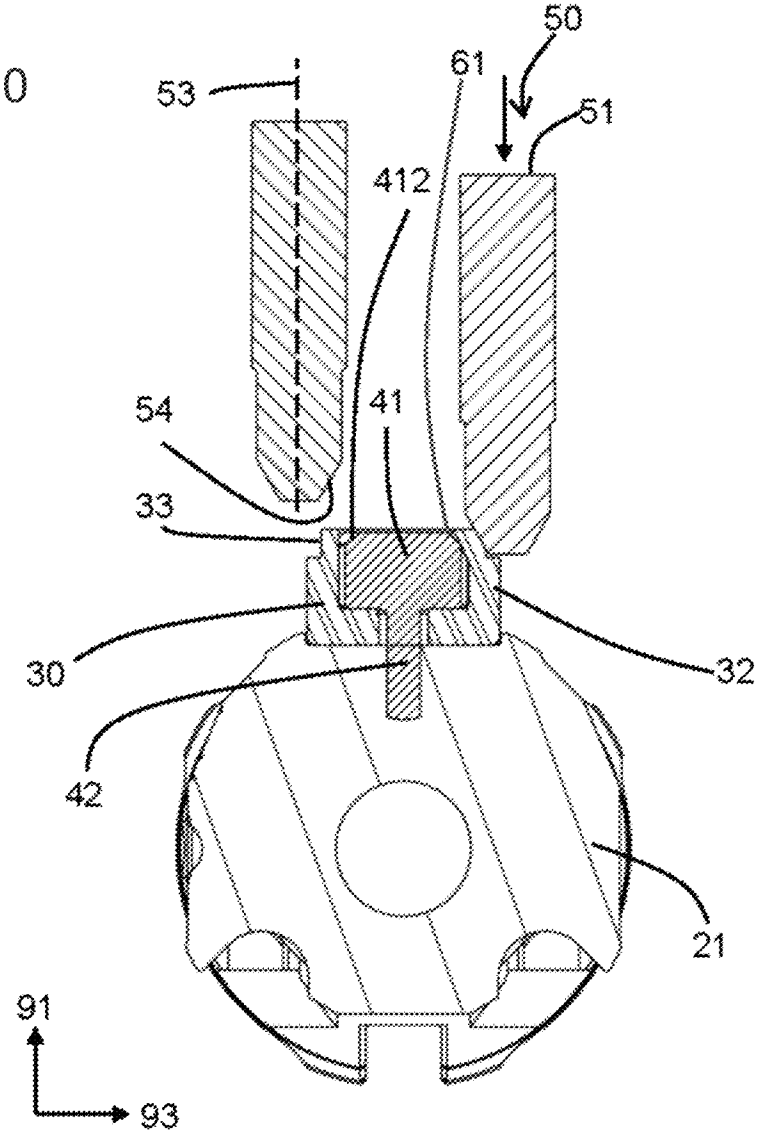
FIG. 10 shows an exemplary process of staking the gas key mounted on the bolt carrier, for example using the staking punch of FIG. 9, from the view in the barrel direction.

FIG. 10 shows the process of staking the gas key 30 mounted on the bolt carrier 21 from the view in the firing direction 92 using the staking punch 50 from FIG. 9. The fastening element 40 used for this purpose has a head 41 and a shaft 42, with the head 41 being able to have a chamfer 412. Preferably, the fastening element 40 is a screw of the type Imperial #10/32-UNF, particularly preferably with a 0.8×45° chamfer. However, the teaching of the disclosure is not limited to this screw as a fastening element 40; a person skilled in the art knows numerous other suitable fastening elements 40, with screws generally being preferred because of the connection being releasable. The gas key 30 comprises the guide surface 32 and the side wall 33. During the staking method, the punch surface 54 of the staking punch 50 is brought into contact with the upper edge of the side wall 33 of the gas key 30 and pressed down in the vertical direction 91. As can readily be seen, the staking punch 50 is aligned in this case such that its top side 51 is at the top in the vertical direction 91. If the staking punch 50 is now pushed onto the gas key 30 in the vertical direction 91 (indicated by the arrow), the side wall 33 of the gas key 30 deforms in such a way that it comes into engagement with the knurling 411, provided such a knurling 411 is present. If, in addition, there is a chamfer 412 on the head 41 of the fastening element 40, a bead 61 is formed, which additionally secures the fastening element 40 axially. The punch 50 when pressed down as described above is in working position. It has to be mentioned that the section shown in FIG. 10 does not pass through the central point 345 of the hole 34, since the staking, as can be seen in FIG. 4B, takes place offset by the angle α 38. The necessary staking pressure and the depth resulting therefrom can be easily determined and adapted by a person skilled in the art.

In summary, it can be stated that the present disclosure relates to a bolt carrier assembly 20 for a firearm 10 having a barrel 11 which extends in the firing direction 92. This bolt carrier assembly 20 comprises a bolt carrier 21 and a gas key 30 having a side wall 33 and a guide surface 32, wherein at least one hole 34 for receiving in each case one fastening element 40 per hole 34 is formed on the gas key 30 along a median plane 301, and the hole 34 comprises a bore 341 which extends along a hole axis 340 passing through a central point 345 and a recess 342 in the upper region. Wherein a region of minimal wall thickness is formed along a normal 36, which intersects the hole axis 340, to the median plane 301 between recess 342 and side wall 33, and wherein the gas key 30 is fastened to the bolt carrier 21 by means of at least one fastening element 40, and wherein for securing the at least one fastening element 40 at least one staking 60 is arranged on a side wall 33 of the gas key 30, wherein the staking 60 is formed at a depth in the side wall 33 and the staking 60, as seen in the firing direction 92, is formed at a distance from the region of minimal wall thickness. In other words, the staking 60 is spaced apart from the region of minimal wall thickness.

Preferably, for securing the at least one fastening element 40, the bolt carrier assembly 20 comprises at least two stakings 60, more preferably the at least one fastening element is secured by four stakings 60 per recess 342 that are arranged in at least one side wall 33 of the gas key 30.

Furthermore, the at least two stakings 60 per recess 342 are preferably arranged on the same side wall 33 of the gas key 30.

It is also preferred that in at least one side wall 33 of the gas key 30 a staking 60 is arranged upstream of the region of minimal wall thickness, as seen in the firing direction 92, and a staking 60 is arranged downstream of the region of minimal wall thickness, as seen in the firing direction 92.

It is also preferred that the four stakings 60 are arranged in a substantially X-shaped manner around the hole 34, in each case two and two, on opposing (i.e. opposite) side walls 33 of the gas key 30 (see FIG. 7B).

It is very particularly preferred that the at least one staking 60 in at least one side wall 33 of the gas key 30 is spaced apart from the region of minimal wall thickness at an angle α 38 between normal 36 and leg 37 of 7.7° to 50°, preferably 15° to 40°, particularly preferably of 25° to 32° (see FIG. 4B).

Another particularly preferred embodiment is that the at least one staking 60 comprises a staking surface which is complementary in shape to a punch surface 54 of a staking punch 50, wherein the staking punch 50 has at least one head 541, 542 and the punch surface 54 and wherein the punch surface 54 is formed at the angle β (546) of 90° to 96°, preferably 92° to 94°, particularly preferably of 93° to the vertical direction 93 (see FIG. 5 and FIG. 6) or at the angle λ (549) to the plane panned by the firing direction 92 and the transverse direction 93 of 30° to 70°, preferably 40° to 65°, particularly preferably of 45 to 60° (see FIG. 9 and FIG. 10). Very particularly preferably, the staking 60 thus forms at the top side 302 of the gas key 30, as seen in the vertical direction 91, a bead 61 which protrudes over the chamfer 412 and is designed for axially securing the fastening element 40 against falling out.

It is also advantageous that the at least one staking 60 comprises a staking surface which is complementary in shape to the punch surface 54 of the staking punch 50, wherein the staking punch 50 comprises a first head 541 and a second head 542 which are connected by means of an indentation 543 (see FIG. 5, FIG. 9 and FIG. 7B).

In addition, it is particularly advantageous if the at least one staking 60 comprises a staking surface which is complementary in shape to the punch surface 54 of the staking punch 50, wherein a height difference 544 between head 541, 542 and indentation 543 is formed.

Preferably, the fastening element 40 along the outer circumference of its head 41 has a surface that allows a form-fitting connection. For example, the knurlings 411 may be used for this. Particularly preferably, the fastening element 40 is a screw with a diameter of Imperial #10/32-UNF. Very particularly preferably, the screw comprises a 0.8×45° chamfer 412, most preferably in addition to a knurled 411 head 41 (FIG. 2).

This disclosure furthermore additionally comprises a staking punch 50 for producing a bolt carrier assembly 20, wherein the staking punch 50 has at least one head 541, 542 and a punch surface 54 and wherein the punch surface 54 is formed at the angle β (546) of 90° to 96°.

Preferably, the staking punch 50 comprises a first head 541 and a second head 542 which are connected by means of an indentation 543.

Particularly preferably, the staking punch 50, has a height difference 544 between head 541, 542 and indentation 543.

Most preferably, the profile of the punch surface 54 of the staking punch 50 has a rounded W shape.

Selected Illustrative Embodiments

This section describes additional aspects and features of selected bolt carrier assemblies and staking punches of the present disclosures presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A1. Bolt carrier assembly (20) for a firearm (10) having a barrel (11) which extends in the firing direction (92), comprising a bolt carrier (21) and a gas key (30) having a side wall (33) and a guide surface (32), where at least one hole (34) for receiving in each case one fastening element (40) per hole (34) is formed on the gas key (30) along a median plane (301), and the hole (34) comprises a bore (341) which extends along a hole axis (340) passing through a central point (345) and a recess (342) in the upper region;

where a region of minimal wall thickness is formed along a normal (36), which intersects the hole axis (340), to the median plane (301) between recess (342) and side wall (33), and where the gas key (30) is fastened to the bolt carrier (21) by means of at least one fastening element (40), characterized in that for securing the at least one fastening element (40) at least one staking (60) is comprised of at least one side wall (33) of the gas key (30) and wherein the at least one staking (60) is formed at a depth in the at least one side wall (33) and the at least one staking (60), as seen in the firing direction (92), is spaced apart from the region of minimal wall thickness.

A2. Bolt carrier assembly (20) according to paragraph A1, characterized in that for securing the at least one fastening element (40) at least two stakings (60), preferably four stakings (60) per recess (342), are arranged in at least one side wall (33) of the gas key (30).

A3. Bolt carrier assembly (20) according to paragraph A2, characterized in that the at least two stakings (60) per recess (342) are arranged on the same side wall (33) of the gas key (30).

A4. Bolt carrier assembly (20) according to paragraph A2 or A3, characterized in that in at least one side wall (33) of the gas key (30) a staking (60) is arranged upstream of the region of minimal wall thickness, as seen in the firing direction (92), and a staking is arranged downstream of the region of minimal wall thickness, as seen in the firing direction (92).

A5. Bolt carrier assembly (20) according to any one of paragraphs 2 to 4, characterized in that the four stakings (60) are arranged in a substantially X-shaped manner around the hole (34), in each case two and two, on opposite side walls (33) of the gas key (30).

A6. Bolt carrier assembly (20) according to any one of the preceding paragraphs, characterized in that the at least one staking (60) in at least one side wall (33) of the gas key (30) is spaced apart from the region of minimal wall thickness at an angle α (38) between normal (36) and leg (37) of 7.7° to 50°, preferably 15° to 40°, particularly preferably of 25° to 32°.

A7. Bolt carrier assembly (20) according to any one of the preceding paragraphs, characterized in that the at least one staking (60) comprises a staking surface which is complementary in shape to a punch surface (54) of a staking punch (50), wherein the staking punch (50) has at least one head (541, 542) and the punch surface (54) and wherein the punch surface (54) is formed at the angle β (546) of 90° to 96°, preferably 92° to 94°, particularly preferably of 93° to the transverse direction (93) or at the angle λ (549) of 30° to 70°, preferably 40° to 65°, particularly preferably of 45 to 60° in respect to the transverse direction (93).

A8. Bolt carrier assembly (20) according to paragraph A7, characterized in that the at least one staking (60) comprises a staking surface which is complementary in shape to the punch surface (54) of the staking punch (50), wherein the staking punch (50) comprises a first head (541) and a second head (542) which are connected by means of an indentation (543).

A9. Bolt carrier assembly (20) according to paragraph A8, characterized in that the at least one staking (60) comprises a staking surface which is complementary in shape to the at the angle β (546) inclined punch surface (54) of the staking punch (50), wherein, as seen normally to the transverse direction (93), a height difference (544) between head (541, 542) and indentation (543) is formed, wherein the height difference (544) is 0.3 mm to 1 mm, preferably 0.5 to 0.8 mm and particularly preferably 0.55 mm to 0.7 mm.

A10. Bolt carrier assembly (20) having a gas key (30) according to any one of the preceding paragraphs, characterized in that the fastening element (40) along the outer circumference of its head (41) has a surface that allows a form-fitting connection.

A11. Bolt carrier assembly (20) having a gas key (30) according to any one of the preceding paragraphs, characterized in that the fastening element (40) is a screw with a diameter of Imperial #10/32-UNF.

A12. Bolt carrier assembly (20) according to paragraphs A10 to A11, characterized in that the screw comprises a knurled (411) head (41), preferably with a chamfer (412), more preferably with a 0.8×45° chamfer (412).

A13. Bolt carrier assembly (20) according to paragraph A12, characterized in that the staking (60) is formed at the top side (302) of the gas key (30), as seen in the vertical direction, as a bead (61) protruding over the chamfer (412) for axially securing the fastening element (40) against falling out.

A14. Staking punch (50) for producing a bolt carrier assembly (20) according to any one of the preceding paragraphs, characterized in that the staking punch (50) has at least one head (541, 542) and a punch surface (54) and wherein the punch surface (54) is formed at the angle β (546) of 90° to 96° to the transverse direction (93) or at the angle λ (549) of 30° to 70°, preferably 40° to 65°, particularly preferably of 45 to 60° in respect to the transverse direction (93).

A15. Staking punch (50) according to paragraph A14, for producing a bolt carrier assembly (20) according to any one of the preceding paragraphs, characterized in that the staking punch (50) comprises a first head (541) and a second head (542) which are connected by means of an indentation (543).

CONCLUSION

In summary, the present disclosure relates to improved bolt carrier assemblies for autoload firearms, in particular with respect to improved gas keys for such bolt carrier assemblies.

The characteristics and variants specified for the individual embodiments and examples disclosed herein may be freely combined with those of the other examples and embodiments and may in particular be used to characterize the bolt carrier assemblies of the disclosure in the claims without necessarily entraining the other details of the respective embodiment or the respective example.

LISTING OF REFERENCE NUMERALS

| | |
|---|---|
| 10 | Firearm |
| 11 | Barrel |
| 112 | Gas tube |
| 113 | Locking chamber |
| 12 | Receiver |
| 13 | Buttstock |
| 14 | Trigger |
| 15 | Grip |
| 20 | Bolt carrier assembly |
| 21 | Bolt carrier |
| 22 | Bolt head |
| 221 | Firing pin |
| 23 | Cam pin |
| 24 | Cam |
| 25 | Threaded holes |
| 30 | Gas key |
| 301 | Median plane |
| 302 | Top side |
| 31 | Gas tube receptacle |
| 32 | Guide surface |
| 33 | Side wall |
| 34 | Hole |
| 340 | Hole axis |
| 341 | Bore |
| 342 | Recess |
| 343 | Inner surface |
| 345 | Central point |

-continued

| | |
|---|---|
| 36 | Normal |
| 37 | Leg |
| 38 | Angle α |
| 40 | Fastening element |
| 41 | Head |
| 411 | Knurling |
| 412 | Chamfer |
| 42 | Shaft |
| 50 | Staking punch |
| 501 | First staking punch |
| 502 | Second staking punch |
| 51 | Top side |
| 52 | Underside |
| 54 | Punch surface |
| 541 | First head |
| 542 | Second head |
| 543 | Indentation |
| 544 | Height difference |
| 545 | Slope |
| 546 | Angle β |
| 547 | flat |
| 548 | Middle portion |
| 549 | Angle λ |
| 60 | Staking |
| 61 | Bead |
| 91 | Vertical direction |
| 92 | Firing direction |
| 93 | Transverse direction |

What is claimed is:

1. A bolt carrier assembly for a firearm, wherein the firearm has a barrel that extends in a firing direction, the bolt carrier assembly comprising:

a bolt carrier; and a gas key having a side wall, a guide surface, and an upper region; wherein at least one hole is formed in the gas key along a median plane of the gas key, the at least one hole including a bore that extends along a hole axis that through a central point and a recess in the upper region of the gas key, and the at least one hole is configured to receive a fastening element;

a region of minimal wall thickness of the gas key between the recess and the side wall is formed along a line that is normal to the median plane of the gas key and that intersects the hole axis; and the gas key is fastened to the bolt carrier by means of at least one fastening element, wherein the at least one fastening element is secured by at least one staking that includes at least one side wall of the gas key, where the at least one staking is formed at a depth in the at least one side wall, and the at least one staking is spaced apart from the region of minimal wall thickness, as seen in the firing direction.

2. The bolt carrier assembly of claim 1, wherein the at least one fastening element is secured by at least two stakings that are arranged in at least one side wall of the gas key.

3. The bolt carrier assembly of claim 2, wherein the at least one fastening element is secured by four stakings per recess that are arranged in at least one side wall of the gas key.

4. The bolt carrier assembly of claim 2, wherein at least two stakings per recess are arranged on the same side wall of the gas key.

5. The bolt carrier assembly of claim 2, wherein four stakings are arranged in a substantially X-shaped manner around the at least one hole, in each case two and two, and arranged on opposing side walls of the gas key.

6. The bolt carrier assembly of claim 1, wherein in at least one side wall of the gas key a staking is arranged upstream of the region of minimal wall thickness, as seen in the firing direction, and a staking is arranged downstream of the region of minimal wall thickness, as seen in the firing direction.

7. The bolt carrier assembly of claim 1, wherein the at least one staking in the at least one side wall of the gas key is spaced apart from the region of minimal wall thickness at an angle α, where the angle α is defined by the line normal to the median plane of the gas key and a leg passing from the central point to a contact point between the side wall and a punch surface of a staking punch, and the angle α has a value of 7.7° to 50°.

8. The bolt carrier assembly of claim 7, wherein the angle α has a value of 15° to 40°.

9. The bolt carrier assembly of claim 7, wherein the angle α has a value of 25° to 32°.

10. The bolt carrier assembly of claim 1, wherein the at least one staking includes a staking surface that is complementary in shape to a punch surface of a staking punch, the staking punch having at least one head, wherein the punch surface forms an angle β of 90° to 96° relative to a transverse direction that is orthogonal to the firing direction.

11. The bolt carrier assembly of claim 10, wherein the punch surface forms an angle β of 92° to 94° relative to the transverse direction.

12. The bolt carrier assembly of claim 10, wherein the punch surface forms an angle β of 93° relative to the transverse direction.

13. The bolt carrier assembly of claim 1, wherein the at least one staking includes a staking surface that is complementary in shape to a punch surface of a staking punch, the staking punch having a punch surface adjacent a slope, such that when the staking punch is in a working position the slope forms an angle λ relative to a plane defined by the firing direction and a transverse direction, where the angle λ is 30° to 70°.

14. The bolt carrier assembly of claim 13, wherein the angle λ of the slope relative to the plane defined by the firing direction and the transverse direction is 40° to 65°.

15. The bolt carrier assembly of claim 13, wherein the angle λ of the slope relative to the plane defined by the firing direction and the transverse direction is 45° to 60°.

16. The bolt carrier assembly of claim 1, wherein the at least one staking includes a staking surface that is complementary in shape to a punch surface of a staking punch, the staking punch having a first head and a second head connected by an indentation.

17. The bolt carrier assembly of claim 16, wherein the at least one staking includes a staking surface that is complementary in shape to the punch surface of the staking punch, where as viewed normally to a transverse direction the punch surface exhibits a height difference between at least one of the first and second head and the indentation, where the height difference is 0.3 mm to 1 mm.

18. The bolt carrier assembly of claim 16, wherein the at least one staking includes a staking surface that is complementary in shape to the punch surface of the staking punch, where as viewed normally to a transverse direction the punch surface exhibits a height difference between at least one of the first and second head and the indentation, where the height difference is 0.5 to 0.8 mm.

19. The bolt carrier assembly of claim 16, wherein the at least one staking includes a staking surface that is complementary in shape to the punch surface of the staking punch, where as viewed normally to the transverse direction the punch surface exhibits a height difference between at least one of the first and second head and the indentation, where the height difference is 0.55 mm to 0.7 mm.

20. The bolt carrier assembly of claim 1, further comprising the fastening element, wherein an outer circumference of a head of the fastening element includes a surface that allows a form-fitting connection.

21. The bolt carrier assembly of claim 20, wherein the fastening element is a screw having a diameter of Imperial #10/32-UNF.

22. The bolt carrier assembly of claim 21, wherein the screw includes a knurled head.

23. The bolt carrier assembly of claim 21, wherein the screw includes a knurled head having a chamfer.

24. The bolt carrier assembly of claim 23, wherein the screw includes a knurled head having a 0.8×45° chamfer.

25. The bolt carrier assembly of claim 24, wherein the staking is formed at a top side of the gas key, as seen in a vertical direction, as a bead protruding over the chamfer, such that the bead serves to axially secure the fastening element against falling out.

26. A staking punch for producing a bolt carrier assembly according to claim 1, the staking punch having at least one head and a punch surface, wherein the punch surface is formed at an angle $\beta$ of 90° to 96° to a transverse direction that is orthogonal to the firing direction, or at an angle $\lambda$ of 30° to 70° in respect to the transverse direction.

27. The staking punch for producing a bolt carrier assembly of claim 26, wherein the staking punch includes a first head and a second head that are connected by an indentation.

* * * * *